US005816254A

United States Patent [19]

Beckles

[11] Patent Number: 5,816,254

[45] Date of Patent: Oct. 6, 1998

[54] EAR RETRACTING SYSTEM

[76] Inventor: Jovanka Beckles, 545 Pierce St. #2303, Albany, Calif. 94706

[21] Appl. No.: 787,924

[22] Filed: Jan. 23, 1997

[51] Int. Cl.[6] ..... A61F 11/00

[52] U.S. Cl. ..... 128/857; 128/866; 2/174

[58] Field of Search ..... 128/846, 848, 128/857, 858, 864, 865, 866; 2/174

[56] References Cited

U.S. PATENT DOCUMENTS

| | | | |
|---|---|---|---|
| 1,772,223 | 8/1930 | Pence | 2/174 |
| 2,051,686 | 8/1936 | Dison | 2/174 |
| 2,198,546 | 4/1940 | Lover | 2/174 |
| 3,235,882 | 2/1966 | Coleman | 2/174 |
| 4,971,072 | 11/1990 | Randall | 128/857 |

*Primary Examiner*—Michael A. Brown

[57] ABSTRACT

A new Ear Retracting System for manipulating the ears of a user away from the head during hair treatment procedures to prevent the ears from being injured. The inventive device includes a right strap, a left strap, a right clip secured to the right strap, a left clip secured to the left strap, a support pad secured to the left strap, and a length of Velcro secured to the right strap and the left strap opposite of the clips for securing the straps juxtaposed to the chin of the user. The right clip engages the helix portion of the user's right ear and the left clip engages the helix portion of the user's left ear. The clips pull downwardly upon the helix portion thereby pulling the ear away from the head allowing the user to apply chemical solutions, dyes, permanent solutions or a curling iron to the user's hair without irritations or burns occuring.

6 Claims, 3 Drawing Sheets

EAR RETRACTING SYSTEM

BACKGROUND OF THE INVENTION

1. Field of the Invention

The present invention relates to Hair Treatment Body Protecting Devices and more particularly pertains to a new Ear Retracting System for manipulating the ears of a user away from the head during hair treatment procedures to prevent the ears from being injured.

2. Description of the Prior Art

The use of Hair Treatment Body Protecting Devices is known in the prior art. More specifically, Hair Treatment Body Protecting Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Hair Treatment Body Protecting Devices include U.S. Pat. No. 5,423,091; U.S. Pat. No. 5,023,954; U.S. Design Pat. No. 305,072; U.S. Pat. No. 4,916,758; U.S. Pat. No. 4,660,229 and U.S. Pat. No. 4,193,396.

While these devices fulfill their respective, particular objectives and requirements, the aforementioned patents do not disclose a new Ear Retracting System. The inventive device includes a right strap, a left strap, a right clip secured to the right strap, a left clip secured to the left strap, a support pad secured to the left strap, and a length of Velcro secured to the right strap and the left strap opposite of the clips for securing the straps.

In these respects, the Ear Retracting System according to the present invention substantially departs from the conventional concepts and designs of the prior art, and in so doing provides an apparatus primarily developed for the purpose of manipulating the ears of a user away from the head during hair treatment procedures to prevent the ears from being injured.

SUMMARY OF THE INVENTION

In view of the foregoing disadvantages inherent in the known types of Hair Treatment Body Protecting Devices now present in the prior art, the present invention provides a new Ear Retracting System construction wherein the same can be utilized for manipulating the ears of a user away from the head during hair treatment procedures to prevent the ears from being injured.

The general purpose of the present invention, which will be described subsequently in greater detail, is to provide a new Ear Retracting System apparatus and method which has many of the advantages of the Hair Treatment Body Protecting Devices mentioned heretofore and many novel features that result in a new Ear Retracting System which is not anticipated, rendered obvious, suggested, or even implied by any of the prior art Hair Treatment Body Protecting Devices, either alone or in any combination thereof.

To attain this, the present invention generally comprises a right strap, a left strap, a right clip secured to the right strap, a left clip secured to the left strap, a support pad secured to the left strap, and a length of Velcro secured to the right strap and the left strap opposite of the clips for securing the straps.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Ear Retracting System apparatus and method which has many of the advantages of the Hair Treatment Body Protecting Devices mentioned heretofore and many novel features that result in a new Ear Retracting System which is not anticipated, rendered obvious, suggested, or even implied by any of the prior art Hair Treatment Body Protecting Devices, either alone or in any combination thereof.

It is another object of the present invention to provide a new Ear Retracting System which may be easily and efficiently manufactured and marketed.

It is a further object of the present invention to provide a new Ear Retracting System which is of a durable and reliable construction.

An even further object of the present invention is to provide a new Ear Retracting System which is susceptible of a low cost of manufacture with regard to both materials and labor, and which accordingly is then susceptible of low prices of sale to the consuming public, thereby making such Ear Retracting System economically available to the buying public.

Still yet another object of the present invention is to provide a new Ear Retracting System which provides in the apparatuses and methods of the prior art some of the advantages thereof, while simultaneously overcoming some of the disadvantages normally associated therewith.

Still another object of the present invention is to provide a new Ear Retracting System for manipulating the ears of a user away from the head during hair treatment procedures to prevent the ears from being injured.

Yet another object of the present invention is to provide a new Ear Retracting System which includes a right strap, a left strap, a right clip secured to the right strap, a left clip secured to the left strap, a support pad secured to the left strap, and a length of Velcro secured to the right strap and the left strap opposite of the clips for securing the straps.

Still yet another object of the present invention is to provide a new Ear Retracting System that reduces scars and pain associated with burning ones ears because of a hot curling iron.

Even still another object of the present invention is to provide a new Ear Retracting System that prevents rashes, irritations or stains on or within the ears of the user from chemical solutions, dyes, permanent solutions and curling irons.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
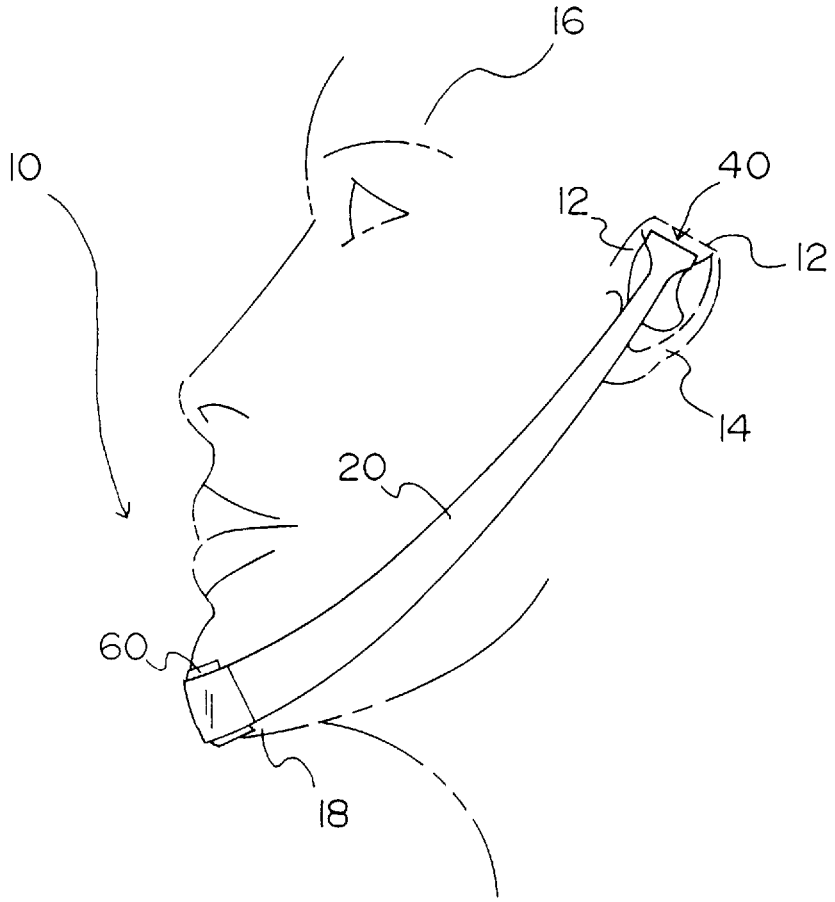
FIG. 1 is an lower perspective view of a new Ear Retracting System according to the present invention.

With reference now to the drawings, and in particular to FIGS. 1 through 6 thereof, a new Ear Retracting System embodying the principles and concepts of the present invention and generally designated by the reference numeral 10 will be described.

More specifically, it will be noted that the Ear Retracting System 10 comprises a right strap 20, a left strap 30, and a securing means 70 attached to the right strap 20 and the left strap 30 for adjustably securing the right strap 20 and the left strap 30 juxtaposed to a chin 18 of a user. The securing means 70 preferably comprises a length of Velcro 70. Alternatively, the securing means 70 comprises an unnumbered buckle member. A right clip 40 is secured to the right strap 20 opposite of the securing means 70 for engaging a helix portion 12 of a right ear 14 of the user for manipulating the right ear 14 away from a head 16 of the user. A left clip 50 is secured to the left strap 30 opposite of the securing means 70 for engaging an unnumbered helix portion of an unnumbered left ear of the user for manipulating the left ear 14 away from the head 16 of the user.

Figure 2:
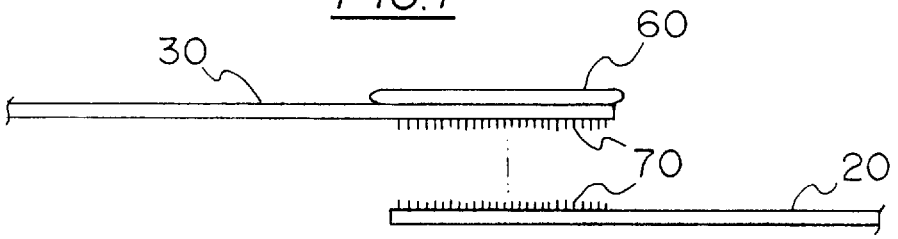
FIG. 2 is an edge view of the Velcro secured to the straps.
Figure 3:
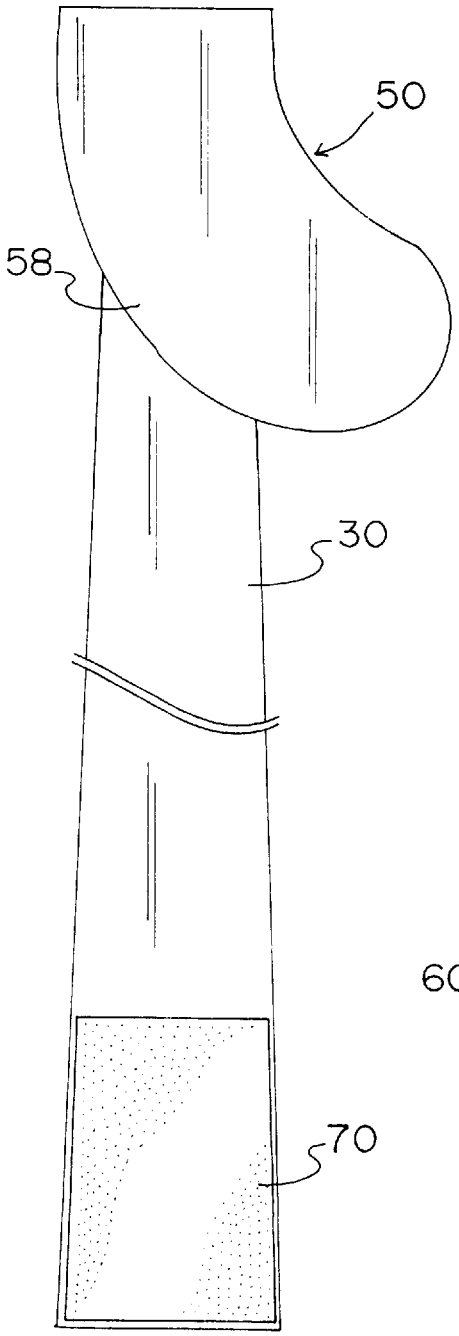
FIG. 3 is a side view of the left clip and left strap.
Figure 4:
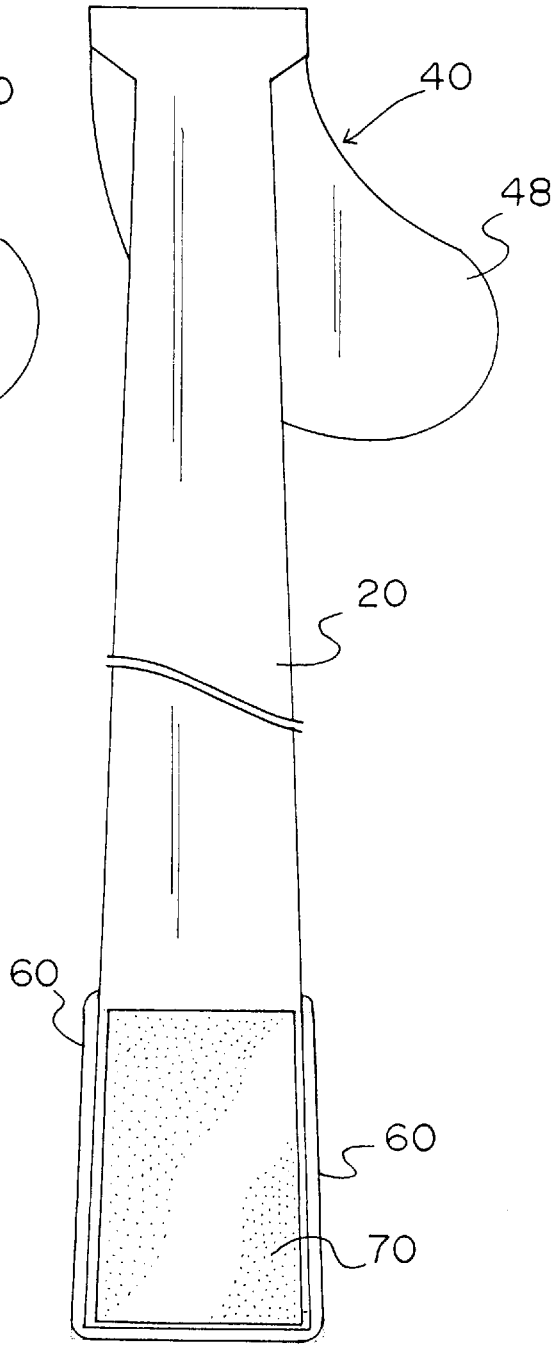
FIG. 4 is a side view of the right clip and right strap.
Figure 5:
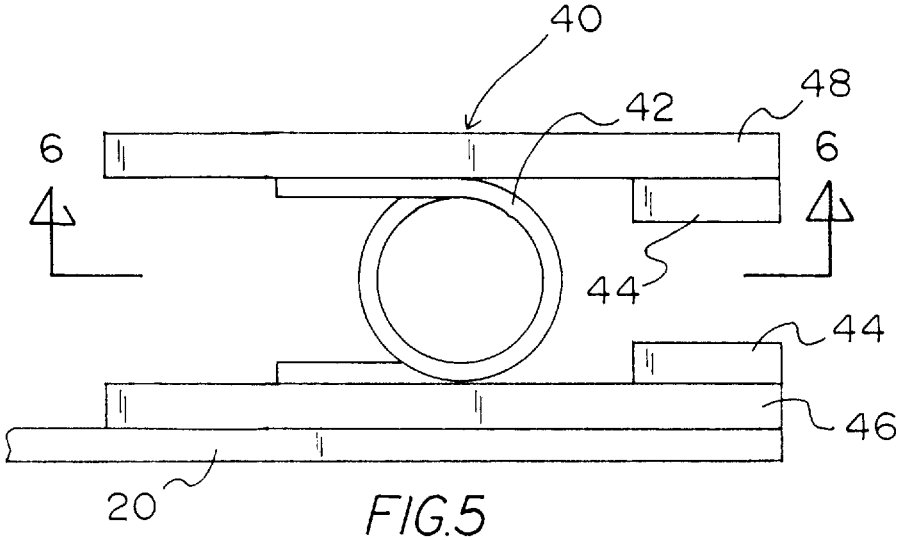
FIG. 5 is an end view of the right clip.
Figure 6:
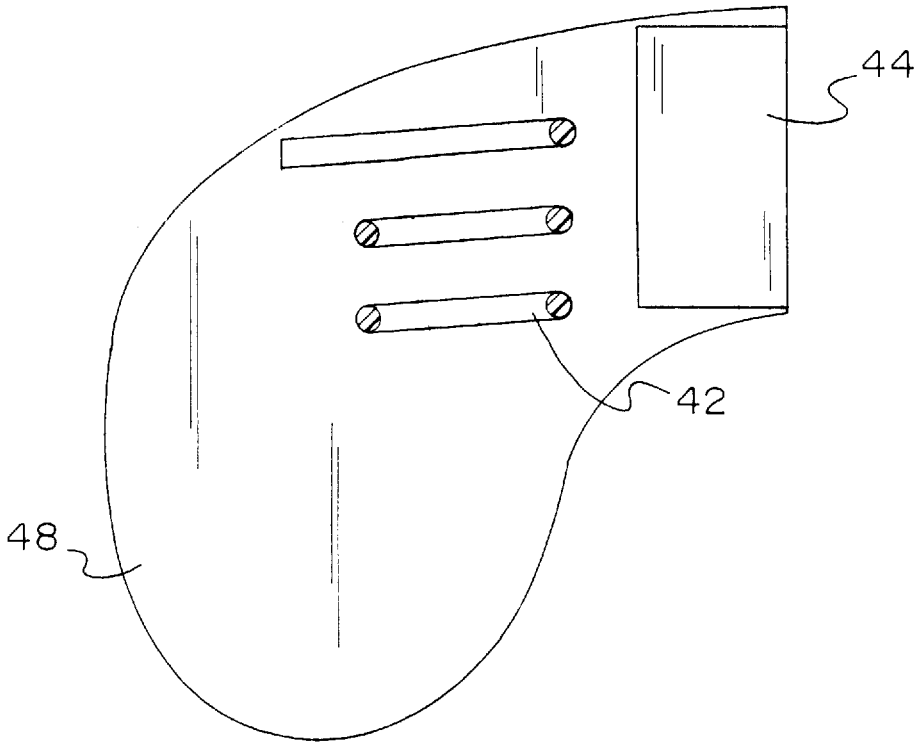
FIG. 6 is a cross sectional view taken along line 6—6 of FIG. 5.

As shown in FIGS. 1, 4, 5 and 6 of the drawings, the right clip 40 comprises a right member 46 secured to the right strap 20 opposite of the securing means 70. A right coil spring 42 is secured at one end to the right member 46 as shown in FIG. 5 of the drawings. A right clip member 48 is secured to the right coil spring 42 opposite of the right member 46 substantially parallel to the right member 46 for springly pivoting with respect to the right member 46. The right coil spring 42 forces the right clip member 48 to removably engage the right member 46 at an engaging edge for clasping upon the helix portion 12 of the right ear 14 of the user. A pair of right comfort pads 44 are secured to the engaging edge of the right member 46 and the right clip member 48 for comfortably gripping the helix portion 12 of the right ear 14. The left clip 50 (shown in FIG. 3) is similar in structure to the right clip 40 as shown in detail in FIG. 5. The left clip 50 includes a left coil spring, left member and left comfort pads which are all similar in structure to the elements of the right clip 40. From this description it should be readily apparent to those skilled in the art to make and use a left clip having analogous structure to the right clip as shown in FIGS. 4–6. The right strap 20 and the left strap 30 preferably comprise an elastic material for constantly applying force upon the helix portion 12 of the user's ears 14. As shown in FIGS. 1, 2 and 4 of the drawings, a support pad 60 is secured to the left strap 30 adjacent to the securing means 70 for comfortably engaging the chin 18 of the user.

As shown in FIG. 3 of the drawings, the left clip 50 comprises an unnumbered left member secured to the left strap 30 opposite of the securing means 70. An unnumbered left coil spring is secured at one end to the unnumbered left member. A left clip member 58 is secured to the unnumbered left coil spring opposite of the unnumbered left member substantially parallel to the unnumbered left member for springly pivoting with respect to the unnumbered left member. The unnumbered left coil spring forces the left clip member 58 to removably engage the unnumbered left member at an engaging edge for clasping upon the helix portion 12 of the unnumbered left ear of the user. A pair of unnumbered left comfort pads are preferably secured to the engaging edge of the unnumbered left member and the left clip member 58 for comfortably gripping the unnumbered helix portion of the unnumbered left ear.

In use, the user secures the right clip 40 to the helix portion 12 of the right ear 14 and secures the left clip 50 to the unnumbered helix portion of the unnumbered left ear as shown in FIG. 1 of the drawings. The use then adjustably secures the right strap 20 with the left strap 30 by attaching the Velcro 70 to the desired position which produces the desired amount of downward force applied to the helix portion 12 of the ears 14. The support pad 60 is positioned comfortably juxtaposed to the user's chin 18 for increasing the comfort of the user. The downward force applied to the clips 40, 50 forces the helix portion 12 of the ears 14 to fold downwardly away from the head 16 allowing the user to apply chemical solutions or perform various other hair treatments without injuring the ears 14. When the user is finished, the user simply removes the clips 40, 50 from the ears 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An ear retracting system for use on a human head, the system comprising:

a right strap having a length;

a left strap having a length;

a hook and loop securing means attached to said right strap and said left strap for adjustably securing said right strap and said left strap in a position adjacent to a chin of a user, the securing means being adapted to secure said left and right straps together at multiple locations among the lengths of said left and right straps such that the combined lengths of said secured straps is adjustable for fitting the size of a user's head;

a right clip secured to said right strap opposite of said securing means for engaging a helix portion of a right ear of said user for manipulating said right ear away from a head of said user; and a left clip secured to said left strap opposite of said securing means for engaging a helix portion of a left ear of said user for manipulating said left ear away from said head of said user; and a support pad secured to said left strap adjacent to said securing means for comfortable engaging said chin of said user;

wherein said right strap includes a right member secured to said right strap opposite of said securing means;

a right coil spring secured at one end to said right member;

a right clip member secured to said right coil spring opposite of said right member substantially parallel to said right member for springly pivoting with respect to said right member wherein said right coil spring forces said right clip member to removably engage said right member at an engaging edge for clasping upon said helix portion of said right ear of said user; and a pair of right comfort pad secured to said engaging edge of said right member and said right clip member for comfortably gripping said helix portion of said right ear; and wherein said left clip includes:

a left member secured to said left strap opposite of said securing means;

a left coil spring secured at one end to said left member;

a left clip member secured to said left coil spring opposite of said left member substantially parallel to said left member for springly pivoting with respect to said left member wherein said left coil spring forces said left clip member to removably engage said left member at an engaging edge for clasping upon said helix portion of said left ear of said user; and a pair of left comfort pad secured to said engaging edge of said left member and said left clip member for comfortably gripping said helix portion of said left ear;

wherein said right strap and said left strap comprise an elastic material;

wherein said securing means comprises a length of hook and loop fasteners; and wherein said securing means comprises a buckle member.

2. An ear retracting system comprising:

a right strap;

a left strap;

a securing means attached to said right strap and said left strap for adjustably securing said right strap and said left strap juxtaposed to a chin of a user;

a right clip secured to said right strap opposite of said securing means for engaging a helix portion of a right ear of said user for manipulating said right ear away from a head of said user;

a left clip secured to said left strap opposite of said securing means for engaging a helix portion of a left ear of said user for manipulating said left ear away from said head of said user;

said right strap including a right member secured to said right strap opposite of said securing means;

a right coil spring secured at one end to said right member;

a right clip member secured to said right coil spring opposite of said right member substantially parallel to said right member for springly pivoting with respect to said right member wherein said right coil spring forces said right clip member to removably engage said right member at an engaging edge for clasping upon said helix portion of said right ear of said user; and a pair of right comfort pad secured to said engaging edge of said right member and said right clip member for comfortably gripping said helix portion of said right ear; and said left clip including a left member secured to said left strap opposite of said securing means;

a left coil spring secured at one end to said left member;

a left clip member secured to said left coil spring opposite of said left member substantially parallel to said left member for springly pivoting with respect to said left member wherein said left coil spring forces said left clip member to removably engage said left member at an engaging edge for clasping upon said helix portion of said left ear of said user; and a pair of left comfort pad secured to said engaging edge of said left member and said left clip member for comfortably gripping said helix portion of said left ear.

3. The ear retracting system of claim 2, wherein said right strap and said left strap comprise an elastic material.

4. The ear retracting system of claim 3, including a support pad secured to said left strap adjacent to said securing means for comfortably engaging said chin of said user.

5. The ear retracting system of claim 4, wherein said securing means comprises a length of hook and loop fasteners.

6. The ear retracting system of claim 4, wherein said securing means comprises a buckle member.

* * * * *